US005555826A

United States Patent [19]

Satterfield

[11] Patent Number: 5,555,826

[45] Date of Patent: Sep. 17, 1996

[54] SHIFTING NEEDLE CARPET MENDER

[75] Inventor: William H. Satterfield, Dalton, Ga.

[73] Assignee: Spencer Wright Industries, Inc., Dalton, Ga.

[21] Appl. No.: 498,401

[22] Filed: Jul. 5, 1995

[51] Int. Cl.[6] ..... D05C 15/06

[52] U.S. Cl. ..... 112/80.04; 112/80.05; 112/221; 112/443

[58] Field of Search ..... 112/80.03, 80.04, 112/80.05, 80.06, 11, 69, 443, 221

[56] References Cited

U.S. PATENT DOCUMENTS

| | | | |
|---|---|---|---|
| 1,932,516 | 10/1933 | Gilleland | 112/80.05 |
| 3,372,661 | 3/1968 | Looper | 112/80.05 X |
| 4,475,473 | 10/1984 | Samoilov et al. | 112/80.05 X |

FOREIGN PATENT DOCUMENTS

| | | | |
|---|---|---|---|
| 532412 | 1/1941 | United Kingdom | 112/80.05 |

*Primary Examiner*—Paul C. Lewis
*Attorney, Agent, or Firm*—Alan Ruderman

[57] ABSTRACT

A hand-held mending gun for tufting stitches into a backing material has a hollow needle reciprocably driven axially and oscillated laterally so as to form stitches in a backing material laterally offset from other stitches. Zig-zag back-stitches may thus be formed as may other laterally offset stitches. A crank drives a needle carrier in a reciprocating path extending longitudinally along the axis of the needle. The elongated path is defined by constraining the needle carrier to move within a slot in a pivotally mounted yoke member having a pair of spaced apart tines disposed about a cam so that rotation of the cam oscillates the yoke member about the pivot. The cam is driven by gears such that it may make one cycle For each two cycles of reciprocation of the needle to form alternate laterally offset stitches. Cams of various configurations may be utilized so that more than one stitch may be provided at each lateral side.

20 Claims, 3 Drawing Sheets

SHIFTING NEEDLE CARPET MENDER

BACKGROUND OF THE INVENTION

This invention relates to a hand-held tufted carpet mender and more particularly to such a mender having a needle which may be shifted laterally for forming laterally offset stitches.

In the manufacture of tufted carpet when a defect caused by the failure of a tufting machine needle to tuft a loop into the backing material occurs, as when the needle unthreads or the strand of yarn fed to the needle is broken, the carpet is mended by means of a hand-held mender known in the art as a mending gun. An operator standing behind the tufting machine inspects the fabric as it leaves the tufting machine and if a defect is sighted, the mending gun is activated to repair the defect. Such a mending gun is pneumatically powered to reciprocate a needle into and out of the tufted fabric at the location of the missing loops of yarn and a strand of yarn is constantly fed to the needle.

This apparatus functions extremely well when a longitudinal row of stitches that normally would be inserted by a needle are missing from the carpet fabric. However, a substantial amount of carpet is produced when the needles of the tufting machine are shifted laterally so that each needle forms a zig-zag back stitch, or where patterns are produced having back stitches which may be laterally offset by more than one step. A fabric of the former type may also be created by laterally shifting the backing material relative to the needles or by using the process disclosed in U.S. Pat. No. 4,440,102. In such cases when a yarn tuft is not formed by a needle, the mending gun operator must move the mending gun from side-to-side in zig-zag and other fashions in order to mend the defect, a task that is not easily or generally accurately performed.

SUMMARY OF THE INVENTION

Consequently, it is a primary object of the present invention to provide a mending gun for tufted fabric which may repair defects in fabric having tufts with zig-zag or other laterally offset back stitches without requiring the manual movement of the mending gun back and forth laterally relative to the direction in which the fabric is fed.

It is another object of the present invention to provide a tufting mender wherein the needle shifts from side-to-side on successive stitches so that a zig-zag or other offset back stitch may be formed in the backing material.

It is a further object of the present invention to provide a hand-held mending gun for tufting stitches in zig-zag or other offset stitch fashion into a backing, the gun having a needle driven axially along its length and driven transversely to the axial direction on alternate strokes so that the needle may penetrate the backing at locations transversely offset.

Accordingly, the present invention provides a powered hand-held mending gun for tufting stitches into a backing material, the gun having a needle driven in a path having axial and lateral components such that the needle reciprocates out and in relative to the body of the gun and oscillates side-to-side during alternate or other periodic reciprocating cycles. Thus, the gun may provide zig-zag back stitches or other laterally offset stitches in the backing material after the backing material has moved away from a tufting machine at the location of the mending gun without the gun being moved from side-to-side.

The mending gun, which preferably is pneumatically driven, includes a crank for driving a needle carrier constrained to reciprocate along an elongated path which oscillates transversely to the direction of reciprocation. The elongated path is defined by a slot in a yoke member which is pivotally mounted and driven to oscillate by a cam. The cam may make one cycle for each two cycles of the crank so that the needle reciprocates two cycles for each oscillating cycle for zig-zag stitches in the preferred form of the invention.

Preferably, the cam has a first gear mounted to it which meshes with a second gear. The second gear is driven at the same speed as the crank and may have half the number of teeth as the first gear so that the first gear makes one rotation for each two rotations of the second gear. The cam is received between tines forming an opening in the yoke member spaced from the elongated slot, the yoke being journalled for pivoting intermediate the opening and the slot. Rotary motion of the main drive effects rotation of a disk to which the crank is connected and the second gear. As aforesaid, the crank reciprocably drives the needle carrier and the second gear drives the first gear and thus the yoke oscillating cam.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
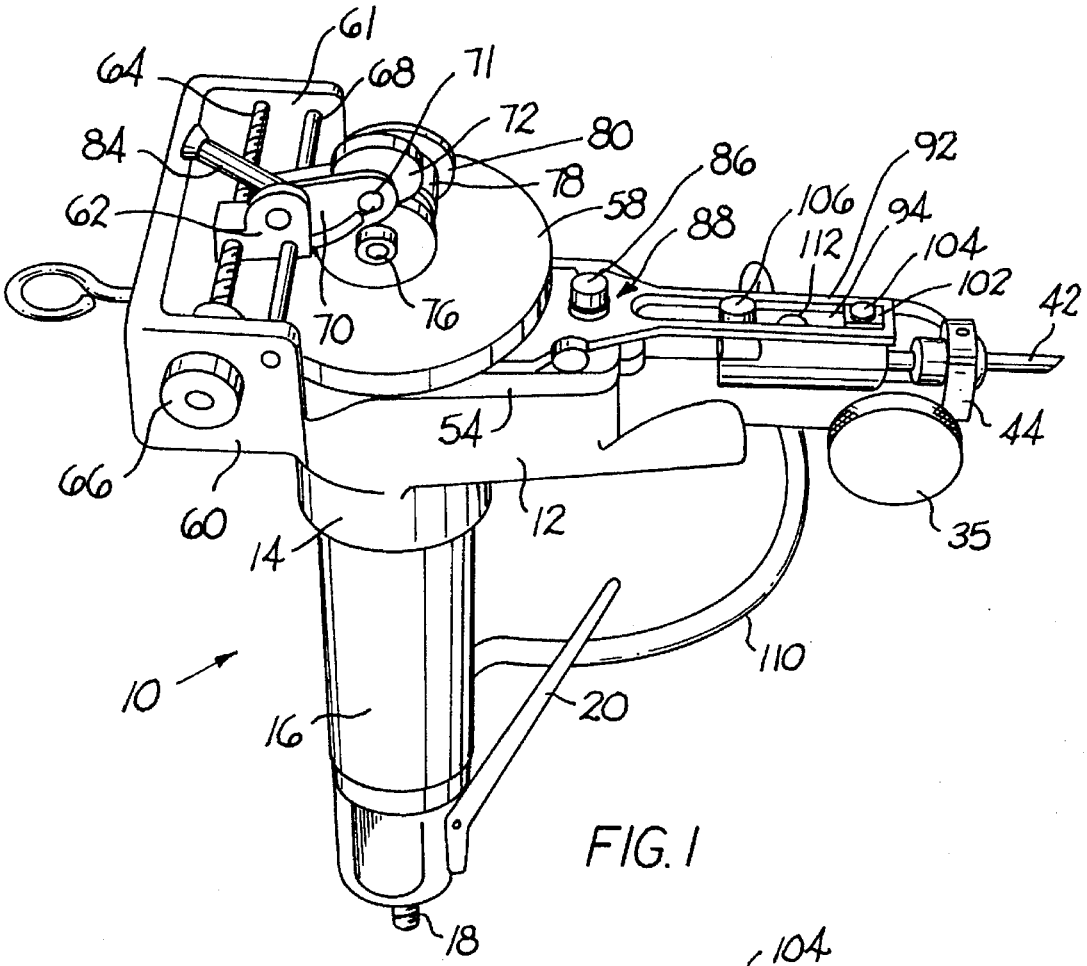
FIG. 1 is a perspective view of a hand-held mending gun constructed in accordance with the principles of the present invention.
Figure 5:
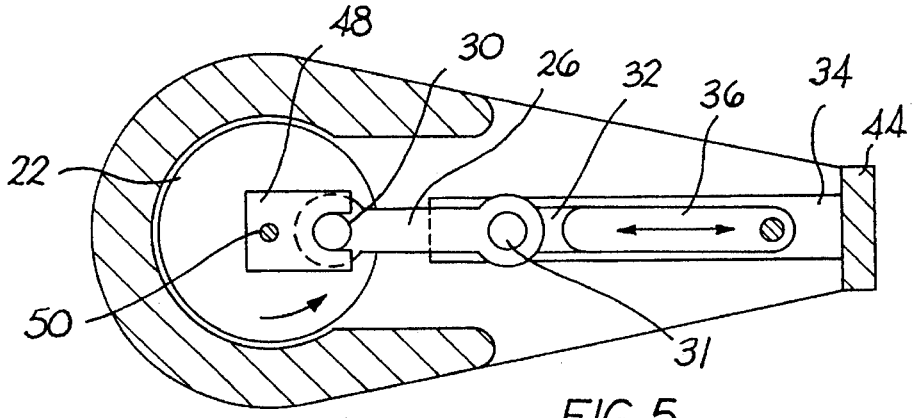
FIG. 5 is a cross sectional view taken substantially along line 5—5 of FIG. 3.
Figures 3, 4:
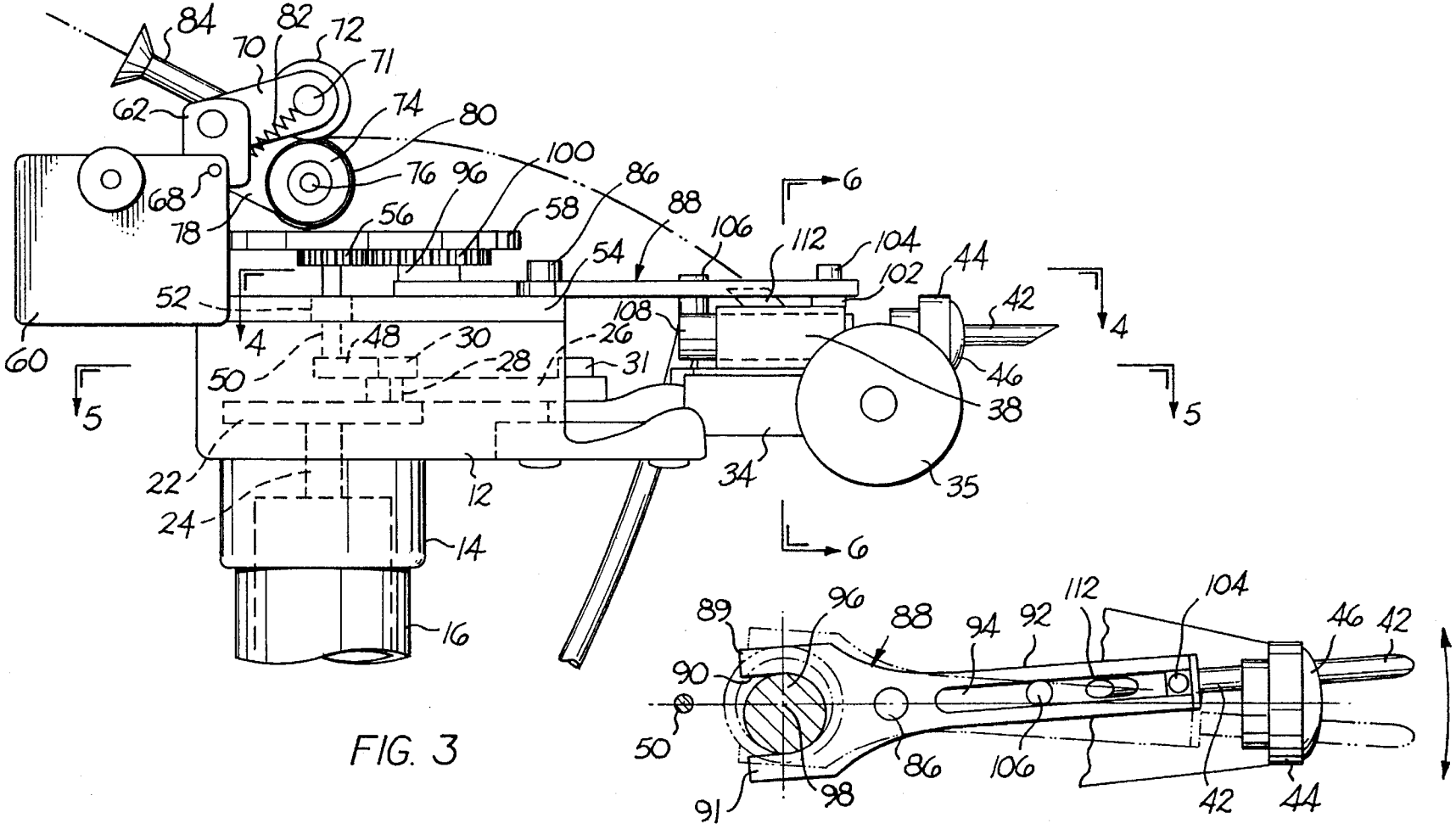
FIG. 3 is an elevational view partly in section of a fragmentary portion of the mending gun.
FIG. 4 is a cross sectional view taken substantially along line 4—4 of FIG. 3.

Referring now to the drawings, FIG. 1 illustrates a mending gun 10 having a main housing 12 including a hollow cylindrical sleeve 14 extending from the bottom thereof. Received within the sleeve is the upper end of a pneumatic rotary motor 16 having an inlet nipple 18 at the lower end adopted to be connected conventionally to a source of high pressure air, a trigger or control lever 20 being manually engaged to activate or deactivate the flow of air into the motor and thus the motor operation. As illustrated in FIG. 3, a disk 22 is secured at its central axis to the output shaft 24 of the motor 16. One end of an arm 26, as best illustrated in FIG. 5, is pivotally connected to the disk 22 by means of a pin 28 secured eccentrically to the disk, the upper end of the pin having a shoulder 30 extending above the arm 26 for reasons hereinafter made clear. The arm 26 extends forwardly and is pivotally connected by a stud 31 to the rear of a piston or shuttle 32 disposed within a barrel 34 positioned within a forwardly extending portion of the housing 12, the barrel 34 being open at the ends and having an open top except at the front portion for receiving the shuttle. A pair of guide wheels 35 are journalled on screws or the like at opposite sides at the front of the barrel for aiding in guiding the mending gun along a backing fabric into which the needle penetrates. As the disk 22 rotates, as driven by the motor 16, the crank provided by the arm 26 and its eccentric mounting, reciprocates the shuttle 32 to and fro within the barrel 34 and thus relatively to the housing 12.

Figure 6:
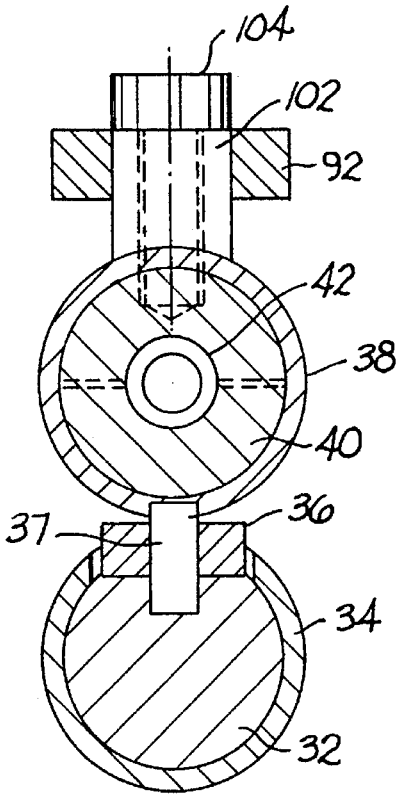
FIG. 6 is a cross sectional view taken substantially along line 6—6 of FIG. 3.
Figure 2:
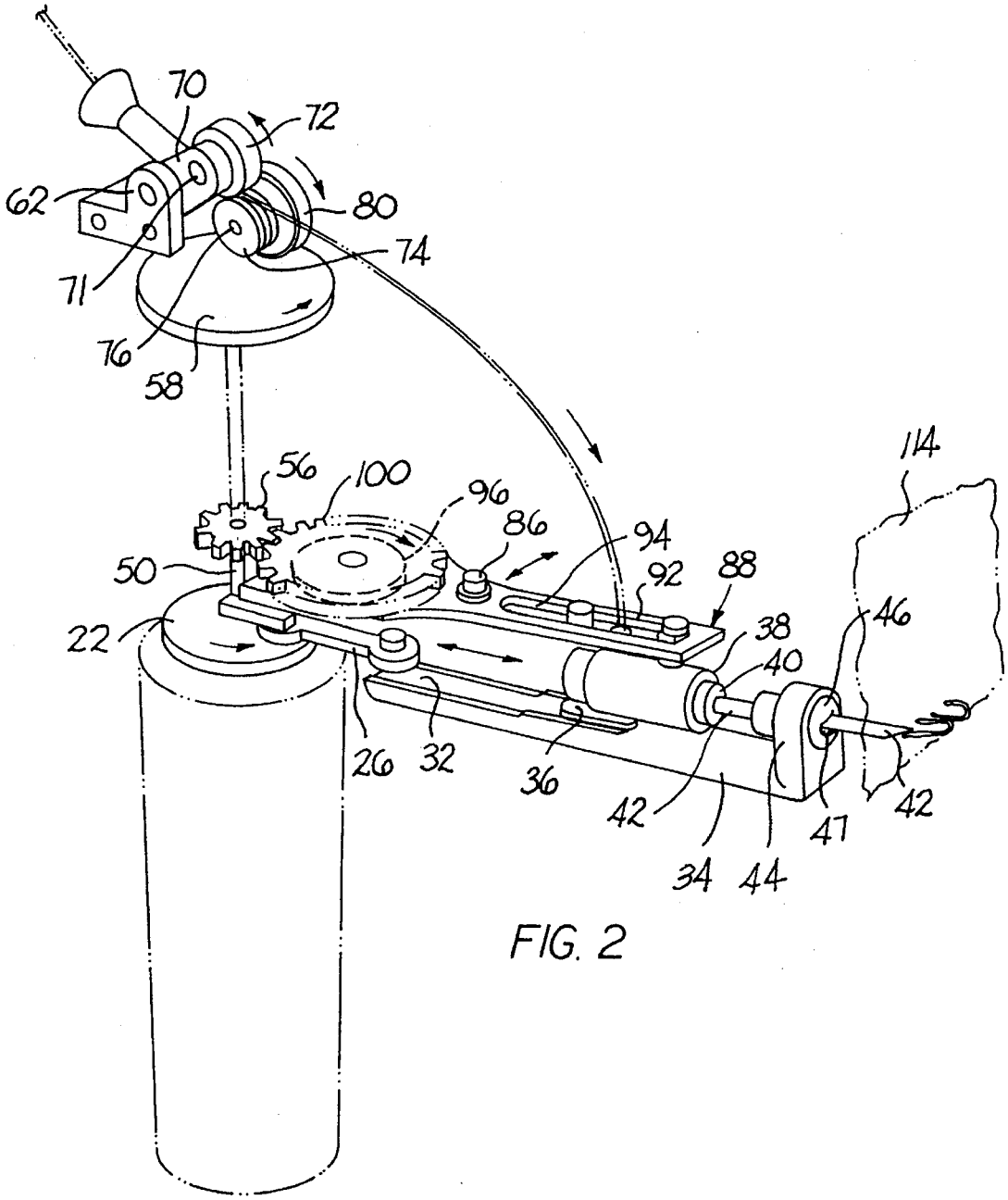
FIG. 2 is a fragmentary partly disassembled perspective view of the mending gun illustrated in FIG. 1.

Fastened to the top of the shuttle 32, as best illustrated in FIG. 6, at a forward portion by a pin member 37 through a spacer 36 is a needle carrier 38, the needle carrier being a hollow cylindrical member having a collet 40 received within the front end. A hollow needle 42 is received through the collet and secured within the needle carrier by securing means such as screw means 104 or the like. A needle guide holder 44 is secured to the front of the barrel and has an upwardly extending portion with an aperture for receiving a needle guide 46, the guide 46 having a slot 47 through which the needle extends, the slot being elongated along one axis with the minor axis disposed in a vertical plane, and the major axis disposed in the horizontal plane so that the needle may be shifted from side-to-side as hereinafter described. Thus, rotation of the motor 16 reciprocates the needle relative to the guide 46 and the housing 12.

Positioned about the shoulder 30 of the pin 28, as best illustrated in FIG. 5, is a U-shaped slot of a drive block 48. A shaft 50 disposed in alignment with the central opening in the disk 22 extends upwardly through an aperture in the block 48 and is secured thereto by set screws. The shaft 50 extends upwardly through bearing means 52 positioned in a hole in a housing cover 54, and then upwardly through the center of a spur gear 56 and has its outer end threaded into a yarn feed roller drive disk 58. Thus, rotation of the disk 22 rotates the drive block 48 by means of the eccentric disposition of the shoulder 30 in the U-shaped slot of the drive block 48 and thus causes the roller drive disk 58 to rotate. Additionally, the gear 56 is secured to the shaft 50 by set screw means so that the gear 56 also rotates with the shaft.

The rear of the housing cover 54 has a pair of upstanding side walls 60, 61 between which a yarn feed support block 62 is-disposed, a threaded rod 64 being received through a tapped bore in the block 62 and extending through the walls 60, 61. The ends of the rod 64 are secured to a respective knurled pile adjusting wheel 66 (only one of which is illustrated). Rotation of one or both wheels 66 translates the block 62 between the walls 60, 61. Another rod 68 is journally carried by the block 62 and pivotably carries one end of a link 70, the other end of the link 70 carrying an axle 71 on which a knurled idle roll 72 is mounted. A knurled yarn feed roll 74 is carried on a shaft 76 supported at the forward end of a support member 78, the member 78 being pivotably carried at its rear end on the rod 68. Also carried on the shaft 76 is a disk 80 having an "O" ring about its periphery. The rolls 72 and 74 are urged into mesh with each other by a spring 82 which is connected between the link 70 and the base of the block 62. A yarn guide tube 84 is carried by the support block 62 so that yarn entering the tube 84 is directed into the nip between the rolls 72 and 74 to be fed through the needle carrier 38 through the needle 42. Rotation of the wheel 66 results in the disk 80 being moved across the drive disk 58, and depending upon the radial location of the "O" ring disk 80 relative to the center of the drive disk 58, the rotational speed of the rolls 72, 74 are increased or decreased to feed more or less yarn to the needle.

Pivotably journalled about the shoulder of a shoulder screw 86 secured to the housing cover 54, is a yoke member 88, which, as hereinafter made clear, is a coupling member coupling the needle carrier to the motor for oscillation. As best illustrated in FIG. 4, the yoke member 88 rearwardly of the pivot screw 86 and disposed below the disk 58 has an enlarged open end slot or yoke 90 forming a pair of spaced apart tines or limbs 89, 91. Extending forwardly of the pivot screw 86, the yoke member narrows down into an elongated leg 92 having an elongated slot 94. In the preferred embodiment a circular cam 96 of a diameter substantially equal to the space in-between the limbs of the yoke 90 is disposed within the open slot of the yoke between the limbs. The cam has an eccentric axis of rotation 98 including a small stud shaft journalled in the housing cover 54. In the preferred embodiment the cam 96 is secured to and formed unitary with a spur gear 100, the gear having its axis concentric with the axis of rotation 98. The gear 100 meshes with the gear 56 and is driven thereby. As the gear 100 rotates, the cam 96, which rotates therewith but eccentrically thereto, causes the yoke member 88 to pivot about the axis of the screw 86 so that the leg 92 alternates from side-to-side which, as hereinafter made clear, results in the needle alternating from side-to-side to form zig-zag stitches. Alternatively, the cam 96 may be of a different configuration so that the needle 42 may make two or more stitches at one side before making the same or a different number of stitches at the other side.

Disposed within the elongated slot 94 at the front thereof is a slide block 102 having a width substantially equal to the width of the slot 94, a screw 104 extending through the slide block 102 and secured within the front of the needle carrier 38 secures the slide block for movement with the needle carrier and thus the needle 42. Additionally, a slide stud 106 having a journally mounted head or bushing of substantially the same diameter as the width of the slot 94 is secured to the rear of the needle carrier with the stud disposed within the slot 94. Preferably, the stud 106 is fastened into a valve 108 which in turn is fastened to the rear of the needle carrier and communicates with the interior of the needle carrier, the valve being connected to an air line which is in turn connected to a vacuum port of the motor 16. A thread guide tube 112 opening into the rear of the needle carrier 38 receives yarn from the yarn feed rolls 72, 74 and the yarn is directed through the needle carrier into the needle. To thread the needle, such as on start-up, a vacuum from the motor 16 is applied to the line 110 and the yarn is drawn through the guide tube 112 into the needle carrier and thus the needle 42. Consequently, the needle carrier together with the needle are jogged or shifted from side-to-side by the coupling of the slide block 102 and the slide stud in the slot 94, the slot also permitting the needle to reciprocate as heretofore described relative to the yoke member as guided by the slot 94.

The number of teeth on the gear 100 is substantially twice that of the gear 56 so that for each revolution of the gear 56, the gear 100 makes one half of a rotation. Thus, since the gear 56 makes one rotation for each reciprocating cycle of the needle 42, the needle makes two reciprocating cycles for each rotation of the gear 100 and makes one cycle for each lateral shift, i.e., the needle is shifted from one side to the other side laterally on alternate reciprocating cycles in the preferred embodiment. The needle thus may create zig-zag stitches in a backing material 114 when the mending gun is held in place manually. With the construction of the present invention, a mending gun as described may thus mend or repair tufted carpet fabric having zig-zag backstitches, or alternatively with a different cam more than one stitch may be formed at one lateral side and then one or more stitches may be formed at the other lateral side, and if desirable, stitches may be formed intermediate the sides.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a hand-held mending gun having a hollow needle elongated along a longitudinal axis, needle mounting means for mounting said needle for reciprocation along said axis, a rotary motor, first drive means coupling said motor to said needle mounting means for converting rotary motion of said motor to reciprocating motion of said needle to reciprocate said needle, the improvement comprising: second drive means coupling said motor to said needle mounting means for oscillating said needle laterally relative to said axis, said second drive means including a coupling member pivotably mounted for oscillation about a pivot axis substantially normal to said longitudinal axis, said coupling member having guide means coupled to said needle mounting means for oscillating said needle mounting means and thereby said needle laterally while permitting said needle mounting means and said needle to reciprocate.

2. In a hand-held mending gun as recited in claim 1, wherein said second drive means includes a cam rotatable about an axis parallel to said pivot axis, said coupling member including follower means driven by said cam for oscillating said coupling member in response to rotation of said cam.

3. In a hand-held mending gun as recited in claim 2, wherein said second drive means further includes a first gear, means connected to said motor for driving said first gear, a second gear disposed in meshing relationship with said first gear and rotatably driven thereby, and means for connecting said cam to said second gear for rotatably driving said cam.

4. In a hand-held mending gun as recited in claim 3, wherein said first drive means includes means for reciprocating said needle mounting means through one reciprocating cycle while said first gear is rotated one revolution, said second gear having twice the number of teeth than said first gear, and said means for connecting said cam to said second gear drives said cam at the same rotational speed as said second gear, whereby said needle may reciprocate through two cycles while oscillating laterally through one cycle.

5. In a hand-held mending gun as recited in claim 2, wherein said coupling member comprises a yoke forming a pair of spaced apart tines defining said follower means, said cam being disposed between said tines.

6. In a hand-held mending gun as recited in claim 5, wherein said second drive means further includes a first gear, means connected to said motor for driving said first gear, a second gear disposed in meshing relationship with said first gear and rotatably driven thereby, and means for connecting said cam to said second gear for rotatably driving said cam.

7. In a hand-held mending gun as recited in claim 6, wherein said first drive means includes means for reciprocating said needle mounting means through one reciprocating cycle while said first gear is rotated one revolution, said second gear having twice the number of teeth than said first gear, and said means for connecting said cam to said second gear drives said cam at the same rotational speed as said second gear, whereby said needle may reciprocate through two cycles while oscillating laterally through one cycle.

8. In a hand-held mending gun as recited in claim 1, wherein said first drive means comprises a disk rotatably driven by said motor, a crank arm having one end mounted eccentrically on said disk and a second end, a slidable shuttle, means connecting said second end of said crank arm to said shuttle for reciprocably sliding said shuttle through one cycle for each revolution of said disk, and means for connecting said needle mounting means to said shuttle for reciprocating therewith.

9. In a hand-held mending gun as recited in claim 8, wherein said second drive means includes a cam rotatable about an axis parallel to said pivot axis, said coupling member including follower means driven by said cam for oscillating said coupling member in response to rotation of said cam.

10. In a hand-held mending gun as recited in claim 9, wherein said second drive means further includes a first gear, means connected to said motor for driving said first gear, a second gear disposed in meshing relationship with said first gear and rotatably driven thereby, and means for connecting said cam to said second gear for rotatably driving said cam.

11. In a hand-held mending gun as recited in claim 10, wherein said first gear is rotatably driven by said motor at substantially the same rotational speed as said disk, said second gear having twice the number of teeth than said first gear, and said means for connecting said cam to said second gear drives said cam at the same rotational speed as said second gear, whereby said needle may reciprocate through two cycles while oscillating laterally through one cycle.

12. In a hand-held mending gun as recited in claim 5, wherein said first drive means comprises a disk rotatably driven by said motor, a crank arm having one end mounted eccentrically on said disk and a second end, a slidable shuttle, means connecting said second end of said crank arm to said shuttle for reciprocably sliding said shuttle through one cycle for each revolution of said disk, and means for connecting said needle mounting means to said shuttle for reciprocating therewith.

13. In a hand-held mending gun as recited in claim 12, wherein said second drive means further includes a first gear, means connected to said motor for driving said first gear, a second gear disposed in meshing relationship with said first gear and rotatably driven thereby, and means for connecting said cam to said second gear for rotatably driving said cam.

14. In a hand-held mending gun as recited in claim 13, wherein said first drive means includes means for reciprocating said needle mounting means through one reciprocating cycle while said first gear is rotated one revolution, said second gear having twice the number of teeth than said first gear, and said means for connecting said cam to said second gear drives said cam at the same rotational speed as said second gear, whereby said needle may reciprocate through two cycles while oscillating laterally through one cycle.

15. In a hand-held mending gun as recited in claim 1, wherein said guide means includes an elongated slot formed in said coupling member, slide means disposed within said slot and constrained thereby, and means for coupling said slide means to said needle mounting means.

16. In a hand-held mending gun as recited in claim 15, wherein said second drive means includes a cam rotatable about an axis parallel to said pivot axis, said coupling member including follower means driven by said cam for oscillating said coupling member in response to rotation of said cam.

17. In a hand-held mending gun as recited in claim 16, wherein said second drive means further includes a first gear, means connected to said motor for driving said first gear, a second gear disposed in meshing relationship with said first gear and rotatably driven thereby, and means for connecting said cam to said second gear for rotatably driving said cam.

18. In a hand-held mending gun as recited in claim 17, wherein said first drive means includes means for reciprocating said needle mounting means through one reciprocating cycle while said first gear is rotated one revolution, said second gear having twice the number of teeth than said first gear, and said means for connecting said cam to said second gear drives said cam at the same rotational speed as said second gear, whereby said needle may reciprocate through two cycles while oscillating laterally through one cycle.

19. In a hand-held mending gun as recited in claim 16, wherein said coupling member comprises a yoke forming a pair of spaced apart tines defining said follower means, said cam being disposed between said tines.

20. In a hand-held mending gun as recited in claim 19, wherein said second drive means further includes a first gear, means connected to said motor for driving said first gear, a second gear disposed in meshing relationship with said first gear and rotatably driven thereby, and means for connecting said cam to said second gear for rotatably driving said cam.

* * * * *